US009140454B2

(12) United States Patent
Lacy et al.

(10) Patent No.: US 9,140,454 B2
(45) Date of Patent: Sep. 22, 2015

(54) BUNDLED MULTI-TUBE NOZZLE FOR A TURBOMACHINE

(75) Inventors: Benjamin Paul Lacy, Greer, SC (US); Willy Steve Ziminsky, Simpsonville, SC (US); Thomas Edward Johnson, Greer, SC (US); Baifang Zuo, Simpsonville, SC (US); William David York, Greer, SC (US); Jong Ho Uhm, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 493 days.

(21) Appl. No.: 12/358,805

(22) Filed: Jan. 23, 2009

(65) Prior Publication Data

US 2010/0186413 A1 Jul. 29, 2010

(51) Int. Cl.

| | |
|---|---|
| ***F23R 3/34*** | (2006.01) |
| ***F23R 3/28*** | (2006.01) |
| ***F23R 3/10*** | (2006.01) |

(52) U.S. Cl.

CPC . *F23R 3/286* (2013.01); *F23R 3/10* (2013.01); *F23R 3/34* (2013.01); *F23D 2900/00008* (2013.01); *F23D 2900/00012* (2013.01)

(58) Field of Classification Search

CPC ..... F23R 3/286; F23R 3/34; F23R 3/10; F23D 2900/00012; F23D 2900/00008

USPC ..... 60/737, 739, 740, 746, 747

See application file for complete search history.

(56) References Cited

U.S. PATENT DOCUMENTS

| | | | | |
|---|---|---|---|---|
| 3,878,992 | A | | 4/1975 | MacManus |
| 4,100,733 | A | | 7/1978 | Striebel et al. |
| 4,262,482 | A | | 4/1981 | Roffe et al. |
| 4,378,744 | A | | 4/1983 | DeFeo et al. |
| 4,408,461 | A | | 10/1983 | Bruhwiler et al. |
| 4,429,527 | A | * | 2/1984 | Teets ..... 60/776 |
| 4,490,171 | A | | 12/1984 | Suzuki et al. |
| 4,763,481 | A | | 8/1988 | Cannon |
| 4,845,952 | A | * | 7/1989 | Beebe ..... 60/737 |
| 4,967,561 | A | | 11/1990 | Bruhwiler et al. |
| 4,986,068 | A | | 1/1991 | Lee et al. |
| 5,000,004 | A | | 3/1991 | Yamanaka et al. |

(Continued)

FOREIGN PATENT DOCUMENTS

CN 1884910 A 12/2006

OTHER PUBLICATIONS

Extended European Search Report for EP Application No. 12179234.5-1602, dated Dec. 13, 2013, pp. 1-7.

(Continued)

*Primary Examiner* — Ted Kim

(57) ABSTRACT

A turbomachine includes a compressor, a combustor operatively connected to the compressor, an end cover mounted to the combustor, and an injection nozzle assembly operatively connected to the combustor. The injection nozzle assembly includes a cap member having a first surface that extends to a second surface. The cap member further includes a plurality of openings. A plurality of bundled mini-tube assemblies are detachably mounted in the plurality of openings in the cap member. Each of the plurality of bundled mini-tube assemblies includes a main body section having a first end section and a second end section. A fluid plenum is arranged within the main body section. A plurality of tubes extend between the first and second end sections. Each of the plurality of tubes is fluidly connected to the fluid plenum.

20 Claims, 6 Drawing Sheets

(56) References Cited

U.S. PATENT DOCUMENTS

| | | | | |
|---|---|---|---|---|
| 5,193,346 | A | 3/1993 | Kuwata et al. | |
| 5,199,265 | A | 4/1993 | Borkowicz | |
| 5,235,814 | A | 8/1993 | Leonard | |
| 5,247,797 | A | 9/1993 | Fric et al. | |
| 5,259,184 | A | 11/1993 | Borkowicz et al. | |
| 5,263,325 | A | 11/1993 | McVey et al. | |
| 5,277,022 | A | 1/1994 | Shekleton et al. | |
| 5,321,951 | A * | 6/1994 | Falls et al. | 60/748 |
| 5,339,635 | A | 8/1994 | Iwai et al. | |
| 5,400,968 | A | 3/1995 | Sood | |
| 5,475,979 | A | 12/1995 | Oag et al. | |
| 5,490,378 | A | 2/1996 | Berger et al. | |
| 5,518,697 | A | 5/1996 | Dalla Betta et al. | |
| 5,575,146 | A | 11/1996 | Borkowicz et al. | |
| 5,590,529 | A | 1/1997 | Joshi et al. | |
| 5,657,632 | A | 8/1997 | Foss | |
| 5,680,766 | A | 10/1997 | Joshi et al. | |
| 5,685,139 | A | 11/1997 | Mick et al. | |
| 5,761,897 | A | 6/1998 | Kramer | |
| 5,778,676 | A | 7/1998 | Joshi et al. | |
| 5,865,030 | A | 2/1999 | Matsuhama | |
| 5,881,756 | A | 3/1999 | Abbasi et al. | |
| 5,930,999 | A * | 8/1999 | Howell et al. | 60/737 |
| 5,943,866 | A | 8/1999 | Lovett et al. | |
| 6,019,596 | A | 2/2000 | Knopfel et al. | |
| 6,174,160 | B1 | 1/2001 | Lee et al. | |
| 6,301,899 | B1 | 10/2001 | Dean et al. | |
| 6,363,724 | B1 | 4/2002 | Bechtel et al. | |
| 6,438,961 | B2 | 8/2002 | Tuthill et al. | |
| 6,442,939 | B1 * | 9/2002 | Stuttaford et al. | 60/737 |
| 6,453,673 | B1 | 9/2002 | Bechtel et al. | |
| 6,623,267 | B1 | 9/2003 | Golladay, Jr. | |
| 6,672,073 | B2 * | 1/2004 | Wiebe | 60/796 |
| 6,681,578 | B1 | 1/2004 | Bunker | |
| 6,813,889 | B2 | 11/2004 | Inoue et al. | |
| 6,895,755 | B2 | 5/2005 | Steinthorsson et al. | |
| 6,993,916 | B2 | 2/2006 | Johnson et al. | |
| 7,007,477 | B2 | 3/2006 | Widener | |
| 7,007,486 | B2 | 3/2006 | Sprouse et al. | |
| 7,107,772 | B2 * | 9/2006 | Chen et al. | 60/737 |
| 7,165,405 | B2 | 1/2007 | Stuttaford et al. | |
| 7,185,494 | B2 | 3/2007 | Ziminsky et al. | |
| 7,237,384 | B2 | 7/2007 | Stuttaford et al. | |
| 7,246,494 | B2 * | 7/2007 | Currin et al. | 60/748 |
| 7,412,833 | B2 | 8/2008 | Widener | |
| 7,506,510 | B2 | 3/2009 | Thomson | |
| 7,540,154 | B2 | 6/2009 | Tanimura et al. | |
| 7,556,031 | B2 | 7/2009 | Russell | |
| 7,610,759 | B2 | 11/2009 | Yoshida et al. | |
| 7,707,833 | B1 | 5/2010 | Bland et al. | |
| 7,832,212 | B2 | 11/2010 | Bunker | |
| 7,886,991 | B2 | 2/2011 | Zuo et al. | |
| 8,007,274 | B2 | 8/2011 | Johnson et al. | |
| 8,042,339 | B2 | 10/2011 | Lacy et al. | |
| 8,147,121 | B2 | 4/2012 | Lacy et al. | |
| 8,157,189 | B2 | 4/2012 | Johnson et al. | |
| 2003/0010032 | A1 | 1/2003 | Stuttaford et al. | |
| 2005/0050895 | A1 | 3/2005 | Dorr et al. | |
| 2006/0010878 | A1 | 1/2006 | Widener | |
| 2006/0213178 | A1 | 9/2006 | Storey et al. | |
| 2007/0062197 | A1 | 3/2007 | Hannum et al. | |
| 2007/0074518 | A1 | 4/2007 | Rogers et al. | |
| 2008/0053097 | A1 | 3/2008 | Han et al. | |
| 2008/0078160 | A1 | 4/2008 | Kraemer et al. | |
| 2008/0078183 | A1 | 4/2008 | Ziminsky et al. | |
| 2009/0084110 | A1 | 4/2009 | Dudebout et al. | |
| 2009/0229269 | A1 | 9/2009 | Lacy et al. | |
| 2009/0241508 | A1 | 10/2009 | Davis, Jr. et al. | |
| 2009/0249789 | A1 | 10/2009 | Zuo et al. | |
| 2010/0008179 | A1 | 1/2010 | Lacy et al. | |
| 2010/0031662 | A1 * | 2/2010 | Zuo | 60/740 |
| 2010/0101229 | A1 * | 4/2010 | York et al. | 60/737 |
| 2010/0139280 | A1 | 6/2010 | Lacy et al. | |
| 2010/0186413 | A1 | 7/2010 | Lacy et al. | |
| 2010/0192579 | A1 | 8/2010 | Boardman et al. | |
| 2010/0192581 | A1 | 8/2010 | Ziminsky et al. | |
| 2010/0192582 | A1 | 8/2010 | Bland et al. | |
| 2010/0263383 | A1 | 10/2010 | York et al. | |
| 2010/0287937 | A1 | 11/2010 | Thatcher et al. | |
| 2011/0016871 | A1 | 1/2011 | Kraemer et al. | |
| 2011/0113783 | A1 | 5/2011 | Boardman et al. | |
| 2011/0154829 | A1 | 6/2011 | Hayashi et al. | |
| 2013/0031906 | A1 | 2/2013 | Dicintio et al. | |
| 2013/0084534 | A1 | 4/2013 | Melton et al. | |
| 2013/0318975 | A1 | 12/2013 | Stoia et al. | |
| 2013/0318976 | A1 | 12/2013 | Melton et al. | |

OTHER PUBLICATIONS

Chinese Office Action for CN Application No. 200910224888.6, dated Jun. 6, 2013, pp. 1-16.

Extended European Search Report for EP Application No. 09176054.6-1602, dated Apr. 11, 2014, pp. 1-7.

* cited by examiner

BUNDLED MULTI-TUBE NOZZLE FOR A TURBOMACHINE

This invention was made with Government support under Contract No. DE-FC26-05NT42643, awarded by the US Department of Energy (DOE). The Government has certain rights in this invention.

BACKGROUND OF THE INVENTION

The subject matter disclosed herein relates to the art of turbomachines and, more particularly, to a bundled multi-tube nozzle for a turbomachine.

In general, gas turbine engines combust a fuel/air mixture that releases heat energy to form a high temperature gas stream. The high temperature gas stream is channeled to a turbine via a hot gas path. The turbine converts thermal energy from the high temperature gas stream to mechanical energy that rotates a turbine shaft. The turbine may be used in a variety of applications, such as for providing power to a pump or an electrical generator.

In a gas turbine, engine efficiency increases as combustion gas stream temperatures increase. Unfortunately, higher gas stream temperatures produce higher levels of nitrogen oxide (NOx), an emission that is subject to both federal and state regulation. Therefore, there exists a careful balancing act between operating gas turbines in an efficient range, while also ensuring that the output of NOx remains below mandated levels. One method of achieving low NOx levels is to ensure good mixing of fuel and air prior to combustion.

BRIEF DESCRIPTION OF THE INVENTION

According to one aspect of the invention, a turbomachine includes a compressor, a combustor operatively connected to the compressor, and end cover mounted to the combustor, and an injection nozzle assembly operatively connected to the combustor. The injection nozzle assembly includes a cap member having a first surface that extends to a second surface. The cap member further includes a plurality of openings. A plurality of bundled mini-tube assemblies are detachably mounted in respective ones of the plurality of openings in the cap member. Each of the plurality of bundled mini-tube assemblies includes a main body section having a first end section and a second end section. A fluid plenum is arranged within the main body section and a plurality of tubes extend between the first and second end sections. Each of the plurality of tubes includes at least one opening fluidly connected to the fluid plenum.

According to another aspect of the invention, an injection nozzle assembly for a turbomachine includes a cap member including a first surface that extends to a second surface, and a plurality of openings. The injection nozzle assembly also includes a plurality of bundled mini-tube assemblies detachably mounted in respective ones of the plurality of openings in the cap member. Each of the plurality of bundled mini-tube assemblies includes a main body section having a first end section and a second end section, a fluid plenum arranged within the main body section, and a plurality of tubes extending between the first and second end sections. Each of the plurality of tubes includes at least one opening fluidly connected to the fluid plenum.

According to yet another aspect of the invention, a method of forming a combustible mixture in an injection nozzle assembly including a cap member includes guiding a first fluid toward a plurality of bundled mini-tube assemblies detachably mounted in the cap member. Each of the plurality of bundled mini-tube assemblies includes a main body section having a first end section, a second end section and a plurality of tubes extending through the main body section. The method further includes passing the first fluid through the plurality of tubes in each of the plurality of bundled mini-tube assemblies and guiding a second fluid into a plenum arranged in respective ones of each of the plurality of bundled mini-tube assemblies. In addition, the method includes passing the second fluid from the plenum into the plurality of tubes in each of the plurality of bundled mini-tube assemblies to form a fuel/air mixture, and discharging the fuel/air mixture from each of the plurality of bundled mini-tube assemblies into a turbomachine combustor.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

The terms "axial" and "axially" as used in this application refer to directions and orientations extending substantially parallel to a center longitudinal axis of a centerbody of a burner tube assembly. The terms "radial" and "radially" as used in this application refer to directions and orientations extending substantially orthogonally to the center longitudinal axis of the centerbody. The terms "upstream" and "downstream" as used in this application refer to directions and orientations relative to an axial flow direction with respect to the center longitudinal axis of the centerbody.

Figure 1:
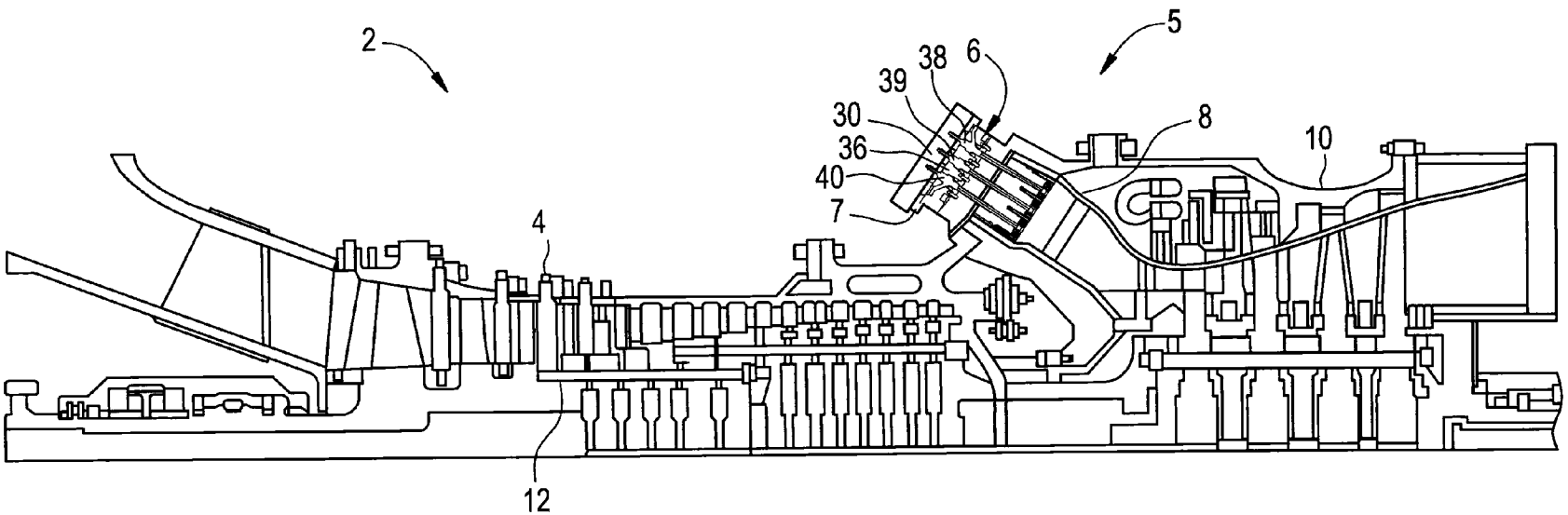
FIG. 1 is a cross-sectional side view of an exemplary turbomachine including a bundled multi-tube injection nozzle constructed in accordance with an exemplary embodiment of the invention.

With initial reference to FIG. 1, a turbomachine constructed in accordance with exemplary embodiments of the invention is generally indicated at 2. Turbomachine 2 includes a compressor 4 and a combustor assembly 5 having at least one combustor 6 provided with a fuel nozzle or injector assembly housing 8. Turbomachine engine 2 also includes a turbine 10 and a common compressor/turbine shaft 12. In one embodiment, gas turbine engine 2 is a PG9371 9FBA Heavy Duty Gas Turbine Engine, commercially available from General Electric Company, Greenville, S.C. Notably, the present invention is not limited to any one particular engine and may be used in connection with other gas turbine engines.

Figure 2:
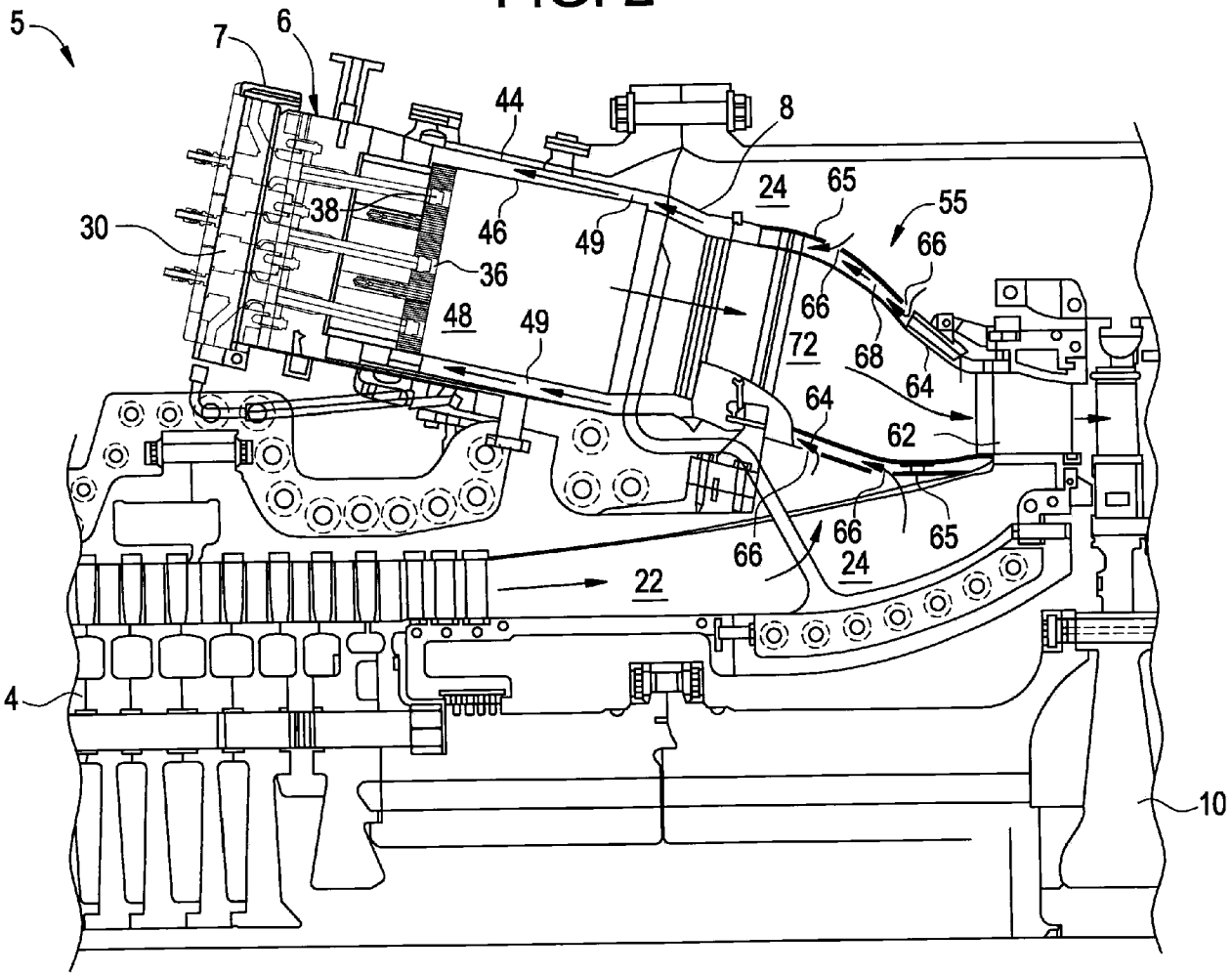
FIG. 2 is a cross-sectional view of a combustor portion of the exemplary turbomachine of FIG. 1.

As best shown in FIG. 2 combustor 6 is coupled in flow communication with compressor 4 and turbine 10. Compressor 4 includes a diffuser 22 and a compressor discharge plenum 24 that are coupled in flow communication with each other. Combustor 6 also includes an end cover 30 positioned at a first end thereof, and a cap member 34. Cap member 34 includes a first surface 35 and an opposing second surface 36 and a plurality of openings, one of which is indicated at 37 in FIG. 3. Cap member 34 is spaced from end cover 30 so as to define an interior flow path 41 through which passes compressed air. As will be discussed more fully below, cap member 34, defines part of an injection nozzle assembly 38. Combustor 6 further includes a combustor casing 44 and a combustor liner 46. As shown, combustor liner 46 is positioned radially inward from combustor casing 44 so as to define a combustion chamber 48. An annular combustion chamber cooling passage 49 is defined between combustor casing 44 and combustor liner 46. A transition piece 55 couple combustor 6 to turbine 10. Transition piece 55 channels combustion gases generated in combustion chamber 48 downstream towards a first stage turbine nozzle 62. Towards that end, transition piece 55 includes an inner wall 64 and an outer wall 65. Outer wall 65 includes a plurality of openings 66 that lead to an annular passage 68 defined between inner wall 64 and outer wall 65. Inner wall 64 defines a guide cavity 72 that extends between combustion chamber 48 and turbine 10.

During operation, air flows through compressor 4 and compressed air is supplied to combustor 6 and, more specifically, to injector assemblies 38, 39, and 40. At the same time, fuel is passed to injector assemblies 38, 39, and 40 to mix with the air and form a combustible mixture. Of course it should be understood that combustor 6 may includes additional injector assemblies (not shown) and turbomachine 2 may include additional combustors (also not shown). In any event, the combustible mixture is channeled to combustion chamber 48 and ignited to form combustion gases. The combustion gases are then channeled to turbine 10. Thermal energy from the combustion gases is converted to mechanical rotational energy that is employed to drive shaft 12.

More specifically, turbine 10 drives compressor 4 via shaft 12 (shown in FIG. 1). As compressor 4 rotates, compressed air is discharged into diffuser 22 as indicated by associated arrows. In the exemplary embodiment, the majority of air discharged from compressor 4 is channeled through compressor discharge plenum 24 towards combustor 6, and the remaining compressed air is channeled for use in cooling engine components. More specifically, pressurized compressed air within discharge plenum 24 is channeled into transition piece 55 via outer wall openings 66 and into annular passage 68. Air is then channeled from annular passage 68 through annular combustion chamber cooling passage 49 and to injection nozzle assemblies 38-40. The fuel and air are mixed forming the combustible mixture that is ignited to form combustion gases within combustion chamber 48. Combustor casing 44 facilitates shielding combustion chamber 48 and its associated combustion processes from the outside environment such as, for example, surrounding turbine components. The combustion gases are channeled from combustion chamber 48 through guide cavity 72 and towards turbine nozzle 62. The hot gases impacting first stage turbine nozzle 62 create a rotational force that ultimately produces work from turbine 2.

Figure 3:
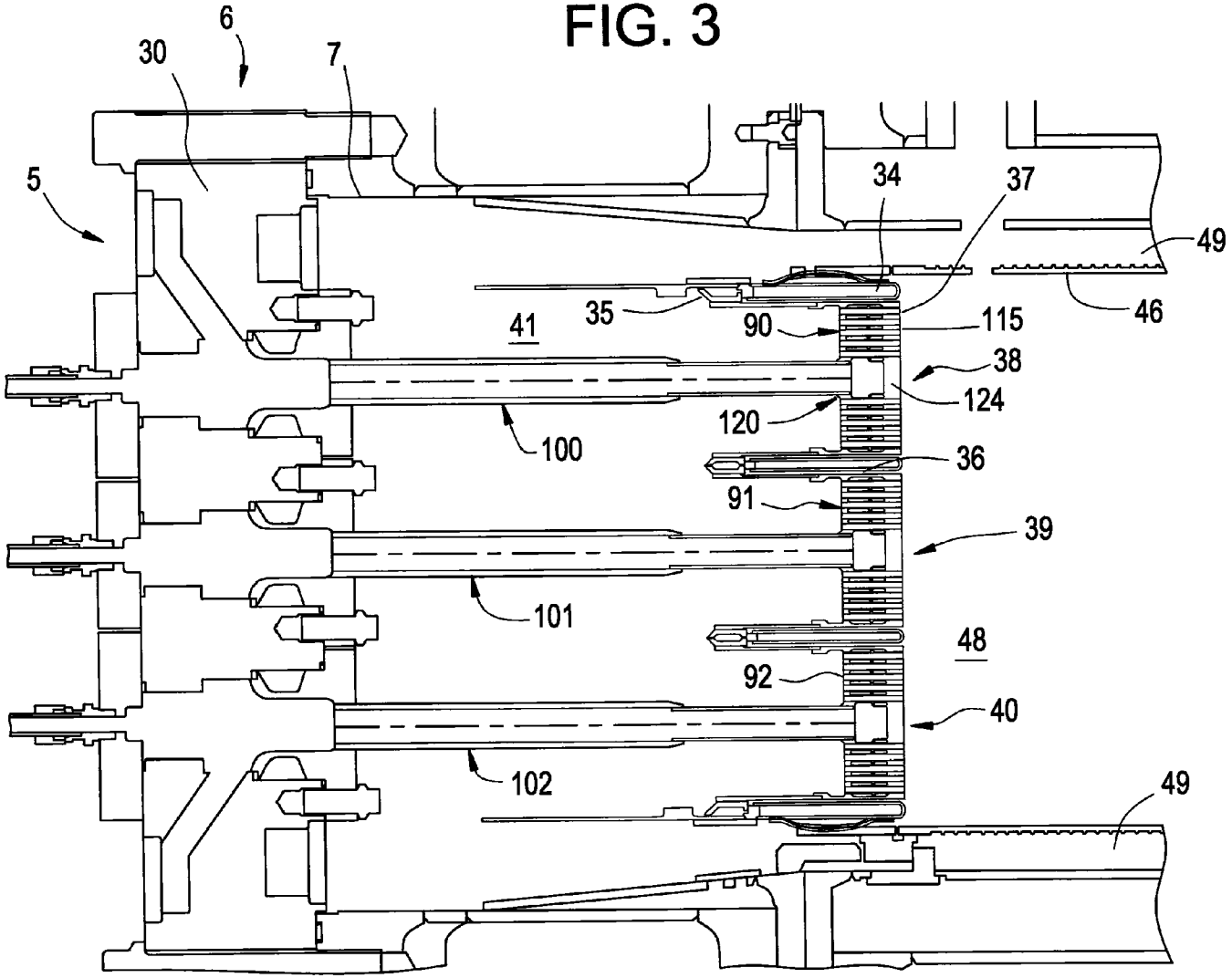
FIG. 3 is s cross-sectional view of a plurality of bundled multi-tube injection nozzles constructed in accordance with exemplary embodiments of the invention.

At this point it should be understood that the above-described construction is presented for a more complete understanding of exemplary embodiments of the invention, which is directed to the particular structure of, for example, injection nozzle assembly 38. As best shown in FIG. 3, injection nozzle assembly 38 includes a plurality of bundled mini-tube assemblies 90-92 detachably mounted in openings 37 formed in cap member 34. As will be discussed more fully below, each bundled mini-tube assembly 90-92 receives fuel from a corresponding fuel inlet tube 100-102 that extends through interior flow path 41 from end cover 30. At this point it should be understood that as each bundled mini-tube assembly 90-91 includes substantially similar structure, a detailed explanation will follow with respect to bundled mini-tube assembly 90 with an understanding that bundled mini-tube assemblies 91 and 92 are substantially similarly constructed. Of course within a given system, bundled mini-tube assemblies could vary in size, number, and number and placement of fuel openings within each tube.

Figure 4:
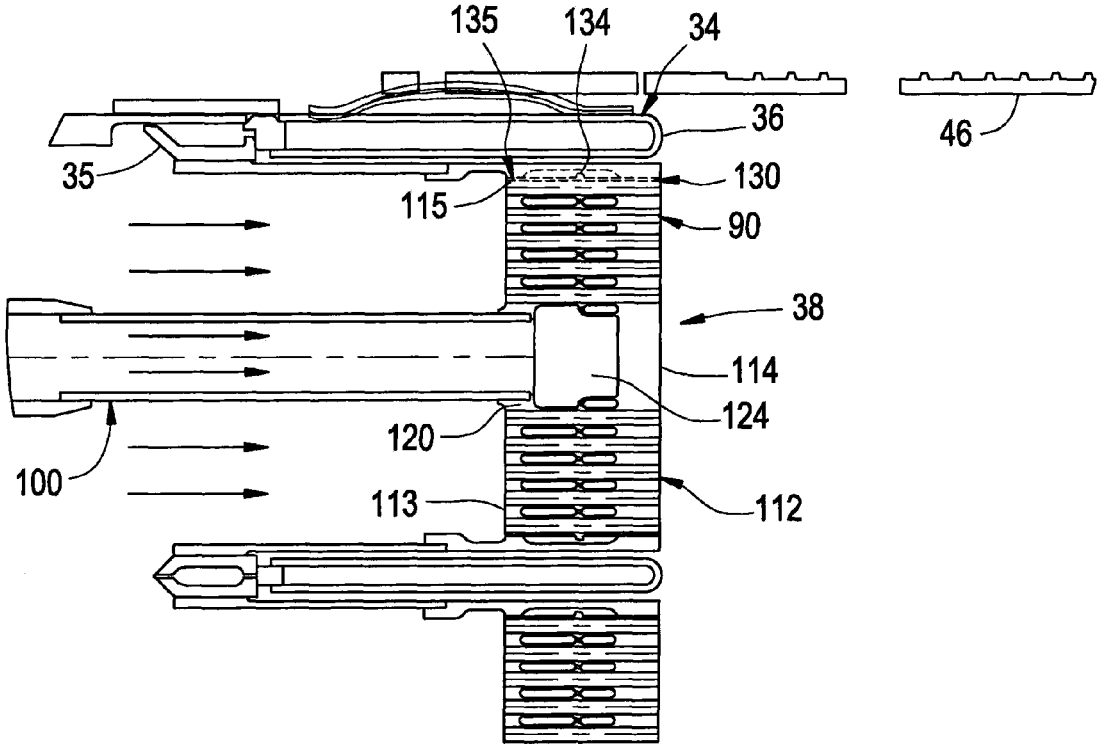
FIG. 4 is a detail, cross-sectional view of one of the plurality of bundled multi-tube injection nozzles of FIG. 3.

As best shown in FIG. 4, bundled mini-tube assembly 90 includes a main body section 112 including a first end section 113 that extends to an opposing, second end section 114. Bundled mini-tube assembly also includes a plurality of mini-tubes, one of which is indicated at 115. Mini-tubes 115 fluidly interconnect interior flowpath 41 and combustion chamber 48. In addition, bundled mini-tube assembly 90 includes a central receiving port 120 that leads to an internal fuel plenum 124. At this point it should be understood that only one internal fuel plenum is shown and describes, exemplary embodiments of the invention could include multiple fuel plenums. In any event, central receiving port 120 is fluidly connected to fuel inlet tube 100. In the exemplary embodiment shown, mini-tubes 115 are arrayed about a central receiving port 120. With this arrangement, fuel enters central receiving port 120 from fuel inlet tube 100. The fuel fills internal fuel plenum 124 and is distributed about each of the plurality of mini-tubes 115. In accordance with one aspect of the invention, each mini-tube 115 includes a fuel inlet such as indicated at 130 arranged proximate to second surface 36 of cap member 34. In this configuration, fuel entering mini tubes 115 is provided with a short interval to mix with air passing through internal flowpath 41 so as to facilitate lean, direct injection of fuel and air into combustion chamber 48.

In accordance with other aspects of the present invention each plurality of mini-tubes 115 includes an opening 134 arranged centrally between first end section 113 and second end section 114. This particular configuration facilitates a partially pre-mixed injection of fuel and air into combustion chamber 48. In accordance with yet another exemplary aspect of the invention each of the plurality of mini tubes 115 includes an opening 135 arranged adjacent to first end section 113 so as to facilitate a more fully pre-mixed injection of fuel and air into combustion chamber 48. The length of tubes 115 and placement of fuel openings will be based on improving operation. Additionally, the bundled mini-tube assembly 90 could have more than one fuel plenum with multiple fuel openings at different axial locations along the plurality of mini-tubes 115.

Figure 5:
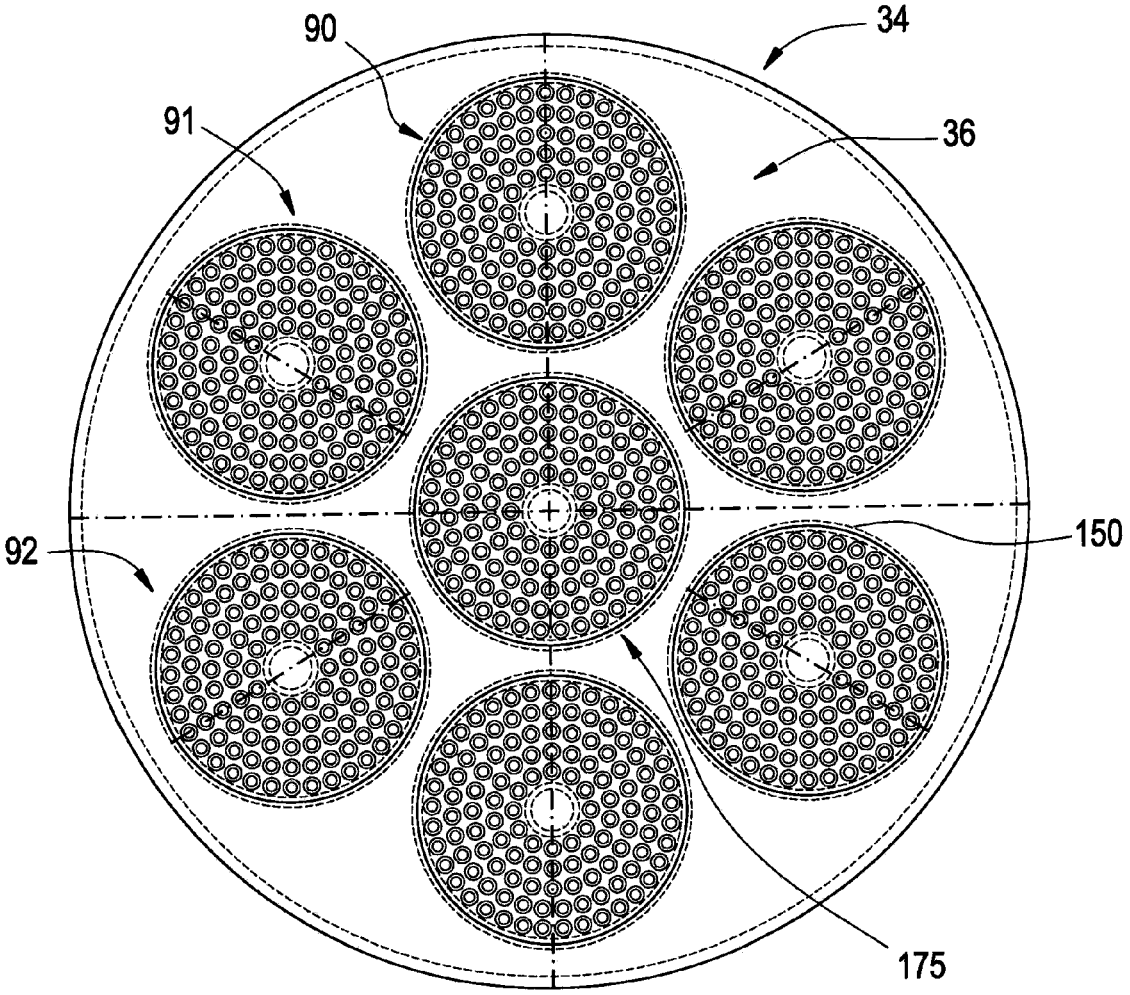
FIG. 5 is an elevational view of a bundled multi-tube injection nozzle arrangement in accordance with one exemplary embodiment of the invention.
Figure 6:
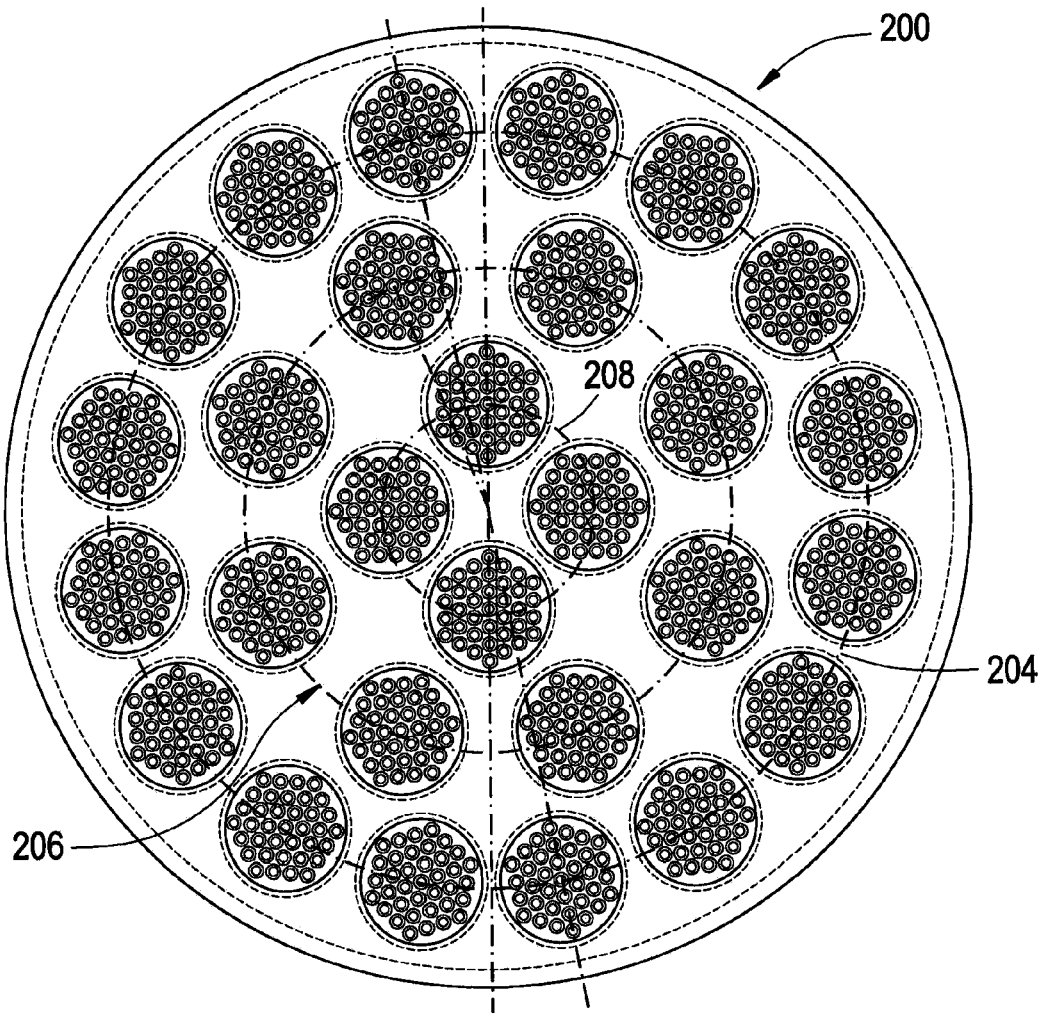
FIG. 6 is an elevational view of a bundled multi-tube injection nozzle arrangement in accordance with another exemplary embodiment of the invention.

As best shown in FIG. 5, bundled mini-tube assemblies 90-92 establish part of an overall annular array 150 of bundled mini-tube assemblies that extend about a central bundled mini-tube assembly 175. With this arrangement, each bundled mini-tube assembly can be constructed similarly or, provided in one of a plurality of configurations, e.g. lean direct injection, partially pre-mixed lean direct injection and fully pre-mixed lean direct injection, to control combustion within a particular combustor. Similarly, as seen in FIG. 6, injection assembly 38 may include a cap member 200 having a plurality of concentric annular arrays of bundled mini-tube assemblies such as indicated at 204, 206 and 208. In a manner similar to that described above, each of the plurality of mini-tube assemblies can be configured identically or, provided in various different configurations in order to control combustion within a particular combustion can. At this point, it should be understood that the present invention provides a unique injection nozzle assembly construction allowing for multiple nozzles to be employed in a single cap member with similar and/or distinct configurations in order to lower emissions from a turbomachine.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbomachine comprising:

a compressor;

a combustor operatively connected to the compressor;

an end cover mounted to the combustor; and an injection nozzle assembly operatively connected to the combustor, the injection nozzle assembly including:

a cap member including a first surface portion that extends to a second surface, and a plurality of openings, each of the plurality of openings extending through the cap member; and a plurality of bundled mini-tube assemblies detachably and directly mounted in respective ones of the plurality of openings in the cap member, each of the plurality of bundled mini-tube assemblies including a main body section including a first end section and a second end section, a fluid plenum arranged within the main body section, and a plurality of tubes extending between the first and second end sections, each of the plurality of tubes including at least one opening fluidly connected to the fluid plenum wherein, the plurality of bundled mini-tube assemblies are arranged on the cap member in an annular array, wherein the plurality of bundled mini-tube assemblies are arranged on the cap member in an annular array that extends circumferentially about a central bundled mini-tube assembly.

2. The turbomachine according to claim 1, wherein each of the plurality of bundled mini-tube assemblies includes a central receiving port, the central receiving port being fluidly connected to the fluid plenum.

3. The turbomachine according to claim 2, wherein the injection nozzle assembly includes a plurality of fluid tubes, each of the plurality of fluid tubes extending between the end cover and the central receiving port on respective ones the plurality of bundled mini-tube assemblies.

4. The turbomachine according to claim 1, wherein the at least one opening in each of the plurality of tubes is formed adjacent the second end section of the main body section.

5. The turbomachine according to claim 1, wherein the at least one opening in each of the plurality of tubes is formed adjacent the first end section of the main body section.

6. The turbomachine according to claim 1, wherein the at least one opening in each of the plurality of tubes is formed substantially centrally within the main body section.

7. An injection nozzle assembly for a turbomachine, the injection nozzle comprising:

a cap member including a first surface that extends to a second surface, and a plurality of openings, each of the plurality of openings extending through the cap member; and a plurality of bundled mini-tube assemblies detachably mounted in respective ones of the plurality of openings in the cap member, each of the plurality of bundled mini-tube assemblies including a main body section having a first end section and a second end section, a fluid plenum arranged within the main body section, and a plurality of tubes extending between the first and second end sections, each of the plurality of tubes including at least one opening fluidly connected to the fluid plenum, wherein the plurality of bundled mini-tube assemblies are arranged on the cap member in an annular array that extends circumferentially about a central bundled mini-tube assembly.

8. The injection nozzle assembly according to claim 7, wherein each of the plurality of bundled mini-tube assemblies includes a central receiving port, the central receiving port being fluidly connected to the fluid plenum.

9. The injection nozzle assembly to claim 8, wherein the injection nozzle assembly includes a plurality of fluid tubes, each of the plurality of fluid tubes extending between an end cover of the turbomachine and the central receiving port on respective ones the plurality of bundled mini-tube assemblies.

10. The injection nozzle assembly to claim 7, wherein the at least one opening in each of the plurality of tubes is formed adjacent the second end section of the main body section.

11. The injection nozzle assembly to claim 7, wherein the at least one opening in each of the plurality of tubes is formed adjacent the first end section of the main body section.

12. The injection nozzle assembly according to claim 7, wherein the at least one opening in each of the plurality of tubes is formed substantially centrally within the main body section.

13. The injection nozzle assembly according to claim 7, wherein one of the plurality of bundled mini-tube assemblies includes a plurality of tubes in which the at least one opening is formed adjacent the second end section of the main body section, and another of the plurality of bundled mini-tube assemblies includes a plurality of tubes in which the at least one opening is formed at one of the first end section of the main body section.

14. A method of forming a combustible mixture in an injection nozzle assembly including a cap member, the method comprising:

guiding a first fluid toward a plurality of bundled mini-tube assemblies detachably mounted in the cap member, each of the plurality of bundled mini-tube assemblies including a main body section including a first end section and a second end section and a plurality of tubes extending through the main body section, the plurality of bundled mini-tube assemblies being arranged on the cap member in an annular array that extends circumferentially about a central bundled mini-tube assembly;

passing the first fluid through the plurality of tubes in each of the plurality of bundled mini-tube assemblies;

guiding a second fluid into a plenum arranged in respective ones of each of the plurality of bundled mini-tube assemblies;

passing the second fluid from the plenum into the plurality of tubes in each of the plurality of bundled mini-tube assemblies to form a fuel/air mixture comprising the first and second fluids; and discharging the fuel/air mixture from each of the plurality of bundled mini-tube assemblies into a turbomachine combustor.

15. The method of claim 14, wherein guiding a second fluid into the plenum comprises guiding the fluid into a central receiving port arranged on each of the plurality of bundled multi-tube assemblies, the central receiving port being fluidly connected to the fluid plenum.

16. The method of claim 15, further comprising: introducing the second fluid into a plurality of fluid tubes, each of the plurality of fluid tubes extending between an end cover of the turbomachine and the central receiving port on respective ones the plurality of bundled mini-tube assemblies.

17. The method of claim 14, further comprising: forming a lean direct injection of fuel and air by passing the second fluid through an opening provided adjacent the second end section of the main body in each of the plurality of tubes.

18. The method of claim 14, further comprising: forming a more fully pre-mixed mixture of fuel and air by passing the second fluid through an opening provided adjacent the first end section of the main body in each of the plurality of tubes.

19. The method of claim 14, further comprising: forming a partially pre-mixed mixture of the first and second fluids by passing the second fluid through an opening provided substantially centrally in each of the plurality of tubes.

20. A turbomachine comprising:

a compressor;

a combustor operatively connected to the compressor;

an end cover mounted to the combustor; and an injection nozzle assembly operatively connected to the combustor, the injection nozzle assembly including:

a cap member including a first surface portion that extends to a second surface, and a plurality of openings, each of the plurality of openings extending through the cap member; and a plurality of bundled mini-tube assemblies detachably and directly mounted in respective ones of the plurality of openings in the cap member, each of the plurality of bundled mini-tube assemblies including a main body section including a first end section and a second end section, a fluid plenum arranged within the main body section, and a plurality of tubes extending between the first and second end sections, each of the plurality of tubes including at least one opening fluidly connected to the fluid plenum wherein, the plurality of bundled mini-tube assemblies are arranged on the cap member in an annular array, wherein one of the plurality of bundled mini-tube assemblies includes a plurality of tubes in which the at least one opening is formed adjacent the second end section of the main body section, and another of the plurality of bundled mini-tube assemblies includes a plurality of tubes in which the at least one opening is formed at one of the first end section of the main body section.

* * * * *